US005615856A

United States Patent [19]

Simington

[11] Patent Number: 5,615,856

[45] Date of Patent: Apr. 1, 1997

[54] BOOK HOLDING DEVICE AND METHOD

[76] Inventor: George H. Simington, 822 SW. 108th St., Ocala, Fla. 34481

[21] Appl. No.: 435,990

[22] Filed: May 5, 1995

[51] Int. Cl.[6] ..... A47B 23/00; A47B 97/02

[52] U.S. Cl. ..... 248/452; 248/451; 248/454; 248/463

[58] Field of Search ..... 248/451–454, 248/463, 442.2

[56] References Cited

U.S. PATENT DOCUMENTS

| | | | |
|---|---|---|---|
| 11,224 | 7/1854 | Hidden . | |
| 201,314 | 3/1878 | Warner . | |
| 439,987 | 11/1890 | Watson | 248/451 |
| 462,467 | 11/1891 | Brown | 248/452 |
| 509,612 | 11/1893 | Curd | 248/451 X |
| 747,188 | 12/1903 | Klee | 248/451 |
| 873,286 | 12/1907 | Barrows | 248/452 |
| 992,509 | 5/1911 | Kobzy | 248/453 |
| 1,111,607 | 9/1914 | Nyberg . | |
| 1,376,272 | 4/1921 | Handley | 248/451 |
| 1,559,366 | 10/1925 | Phelps | 248/451 X |
| 1,692,337 | 11/1928 | Forbes | 248/445 |
| 1,797,889 | 3/1931 | Wiberg | 248/454 |
| 2,136,701 | 11/1938 | Manierre | 248/445 |
| 2,156,225 | 4/1939 | O'Meara . | |
| 2,193,907 | 3/1940 | Love | 248/445 |
| 2,422,877 | 6/1947 | Anderson | 248/454 X |
| 2,454,526 | 11/1948 | Savastano | 248/452 |
| 2,691,239 | 10/1954 | McCollum . | |
| 2,807,908 | 10/1957 | Lykes . | |
| 3,061,969 | 11/1962 | Lunday . | |
| 3,091,886 | 6/1963 | Nutting . | |
| 3,351,312 | 11/1967 | Ballas . | |
| 3,476,348 | 11/1969 | Rustad . | |
| 3,514,066 | 5/1970 | Singleton et al. | 248/463 X |
| 3,586,877 | 6/1971 | Nahmias . | |
| 3,794,284 | 2/1974 | Guenther . | |
| 3,833,197 | 9/1974 | Dyke . | |
| 3,889,914 | 6/1975 | Torme | 248/445 |
| 4,465,255 | 8/1984 | Hill . | |
| 4,496,126 | 1/1985 | Melton et al. . | |
| 4,496,127 | 1/1985 | Nelson . | |
| 4,575,037 | 3/1986 | Hammer . | |
| 4,743,135 | 5/1988 | Gauntlett . | |
| 4,801,120 | 1/1989 | Gregoire . | |
| 4,834,334 | 5/1989 | Robins . | |
| 5,088,677 | 2/1992 | Chandler et al. | 248/451 X |
| 5,375,806 | 12/1994 | Debus et al. | 248/452 |

FOREIGN PATENT DOCUMENTS

| | | | |
|---|---|---|---|
| 0286980 | 7/1935 | Italy | 248/451 |
| 0608077 | 9/1948 | United Kingdom | 248/451 |

*Primary Examiner*—Robert Canfield
*Attorney, Agent, or Firm*—Edward M. Livingston, Esq.

[57] ABSTRACT

A book-holder assembly (45) has a first-side book-support plate (1) and a second-side book-support plate (2) that are oppositely disposed at a desired angle on a plate-connecting member (3) that is attachable to a connector bracket (4) with which universality of positioning is provided by stand means (56, 78) that are designedly foldable or optionally mobile. A first-side page holder (5) that is adjustable separately to thickness of page bunches and a first-side book holder (6) that is adjustable separately to book thicknesses are attachable to the first-side book-support plate. A second-side page holder (7) that is adjustable separately to thickness of page bunches and a second-side book holder (8) that is adjustable separately to book thicknesses are attachable to the second-side book-support plate. A first-side book-holder groove (25) on a bottom side of the first-side book-support plate and a first-side adjustable clamp (30) on a top side of the first-side book support plate provide linear book support on the first-side book-support plate. A second-side book-holder groove (29) on a bottom side of the second-side book-support plate and a second-side adjustable clamp (35) on a top side of the second-side book support plate provide linear book support on the second-side book-support plate.

25 Claims, 6 Drawing Sheets

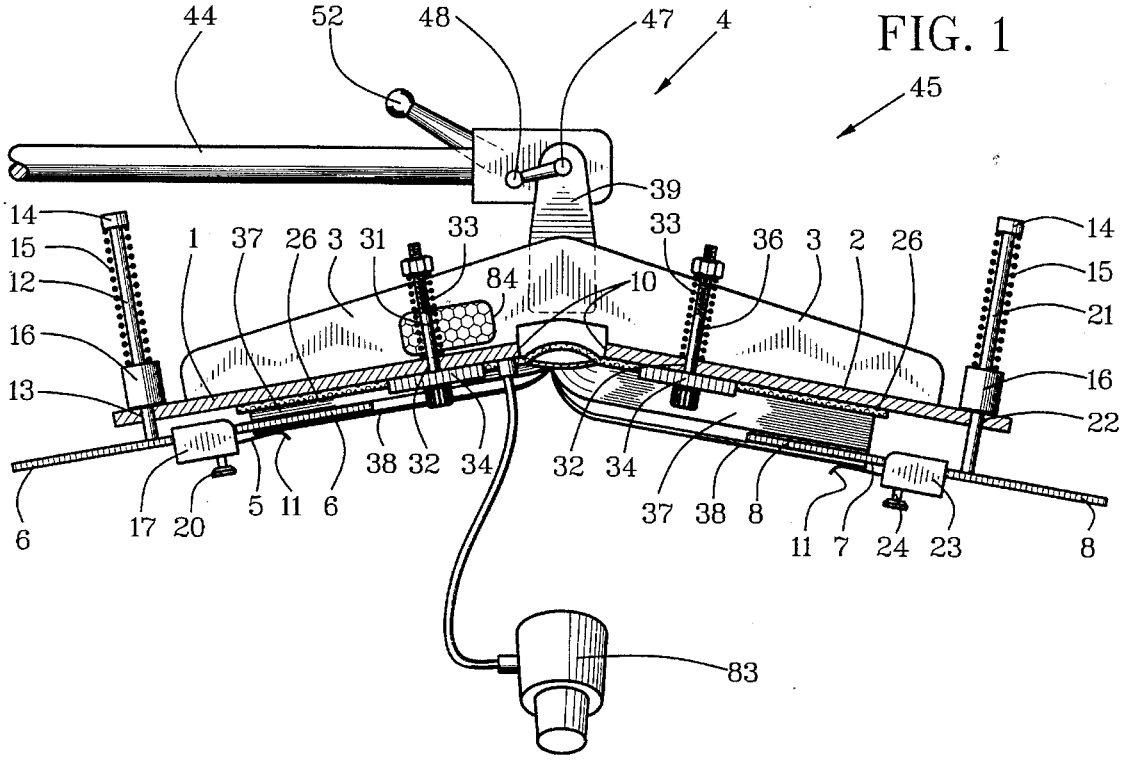
FIG. 1
FIG. 2
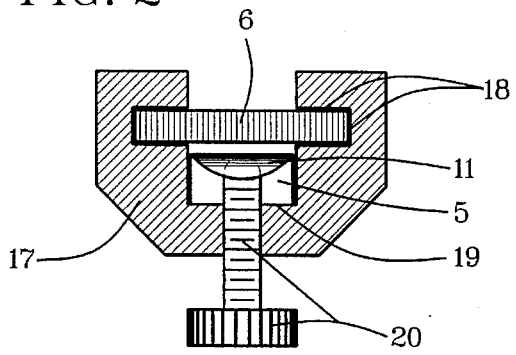
FIG. 3
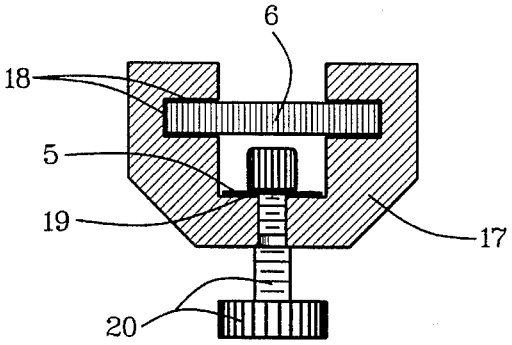
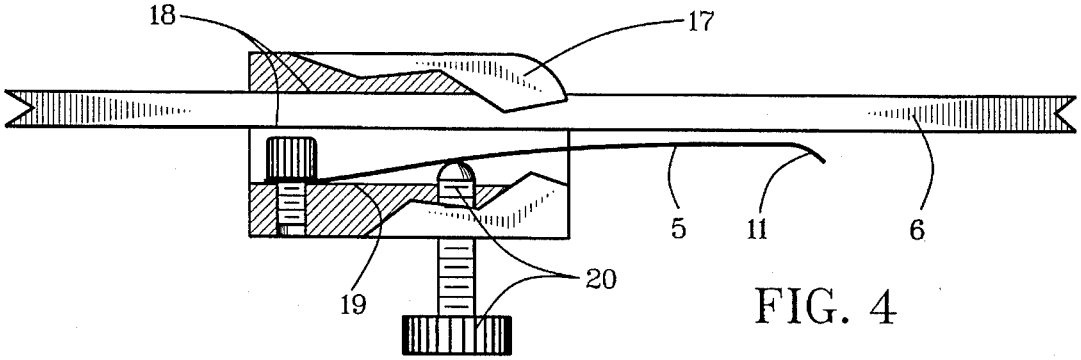
FIG. 4

FIG. 6
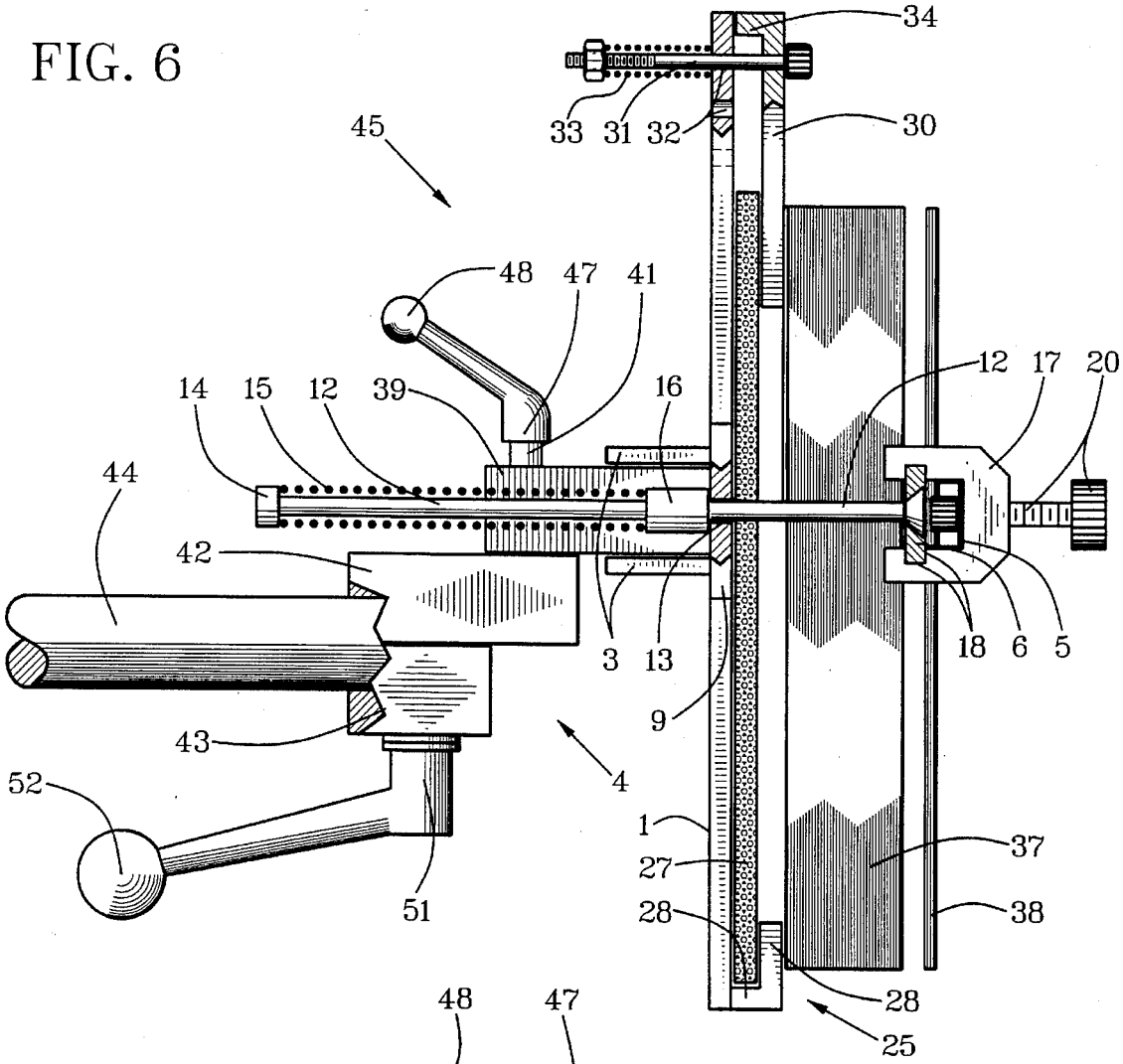
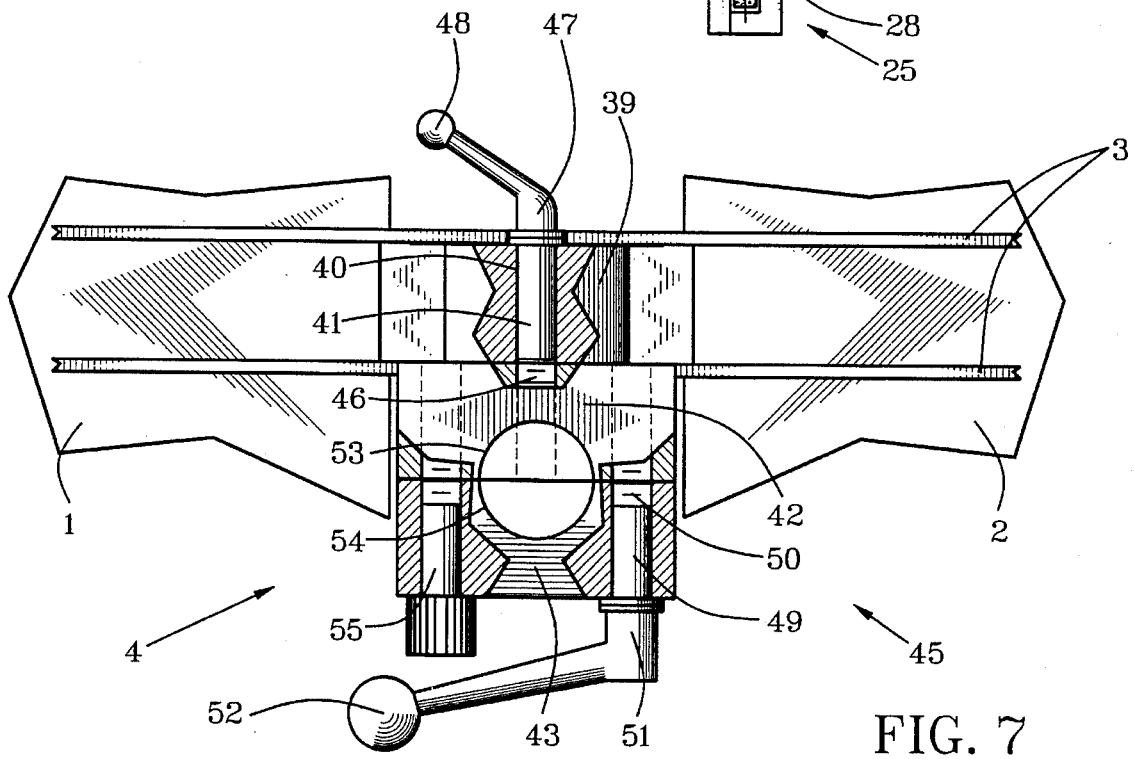
FIG. 7

57
63
58
45
60
64
66
65
44
17
20
5
1
30
6
67
9
10
26
35
37
2
38
8
7
24
70
23
59
9
69
25
29
37
38
26
68
62
61
56

FIG. 12
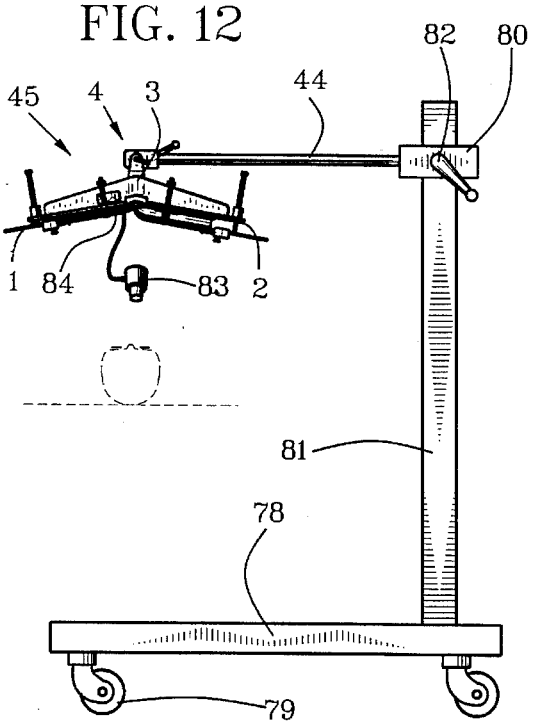
FIG. 13
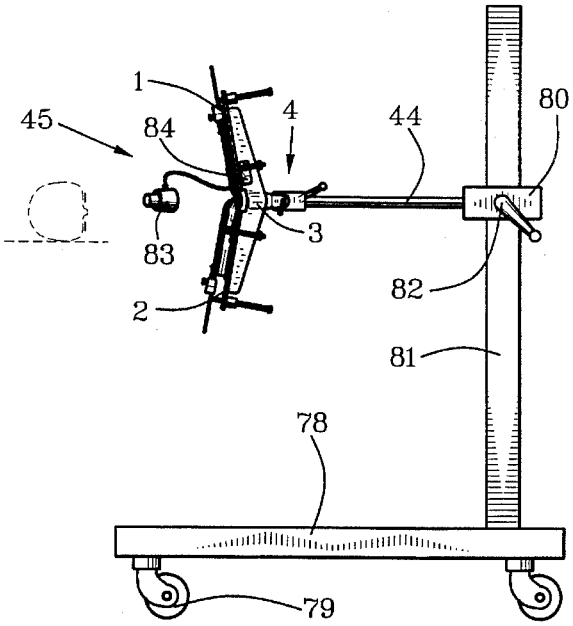
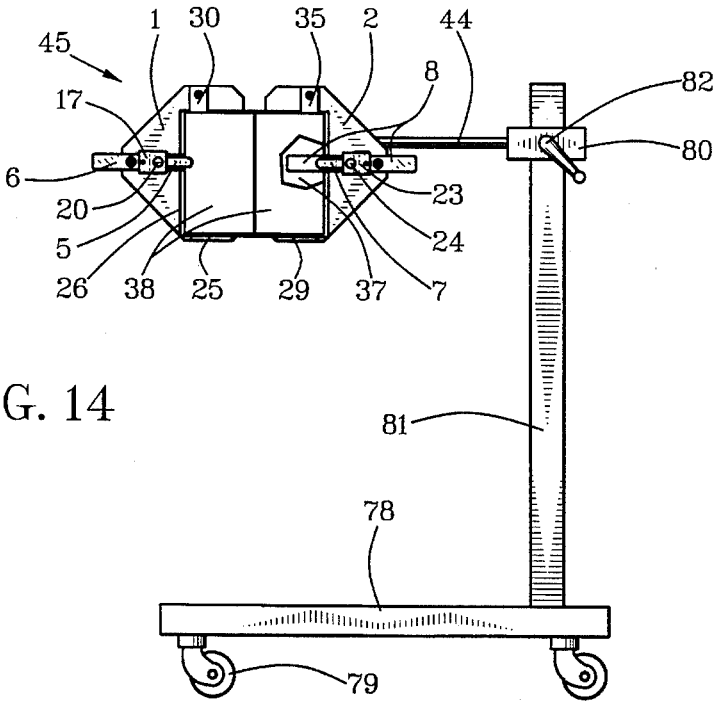
FIG. 14

BOOK HOLDING DEVICE AND METHOD

BACKGROUND OF THE INVENTION

This invention relates to book holders, and in particular, to a book holder that holds bulk pages of a book separately from pages being read and turned with ease, speed and low fatigue level during reading sessions in addition to providing versatility of use and folding for carriage.

Holders of books for reading have been devised and modified prolifically since printing presses made books available. All have had utility that has aided reading of books. None have had page-turning convenience, positioning universality, fold-up structure and on-board lighting in the manner taught by this invention. Pertinent examples of different book-holding devices include the following:

U.S. Pat. No. 11,224, issued to Hidden on Jul. 4, 1854, taught a book-reading and book-writing stand quite similar to a drafting table on a pivotal arm. It also had a light holder on a flexible arm for holding early wick-type lamps for reading and writing books. U.S. Pat. No. 2,156,225, issued to O'Meara on Apr. 25, 1939, described a reading stand with page-holding leaf springs that also held entire sides of books. U.S. Pat. No. 2,807,908, issued to Lykes on Oct. 1, 1957, taught a slight modification of the Hidden device with a strap for holding books in an inverted attitude for reading in bed. U.S. Pat. No. 3,586,847, issued to Nahmias on Jun. 22, 1971, taught a spring-biased U-holder on each of two covers with which a book was held with variable angles between opposite covers. Finally, U.S. Pat. No. 4,465,255, issued to Hill on Aug. 14, 1984, taught a book holder supported by a base member positioned between a mattress and a spring of a bed and having means for supporting a book in an inverted attitude. A large number of other patents in this field teach other forms of book holders that are more different yet from this invention. Regardless of there being many known forms of book holders, none other than a simple pulpit-like stand with only limited versatility have provided sufficient utility to become widely used.

SUMMARY OF THE INVENTION

In light of problems that have existed and that continue to exist in this field, objectives of this invention are to provide a book holder which:

Provides convenient, fast, non-fatiguing and easy page-turning between opposite-side page-holders that are separate from oppositely disposed side holders of books;

Holds books equally well in all attitudinal positions;

Has universal positioning for use with any body positioning of a user;

Is adaptable for use with all known and foreseeable ergonomic furnishings related to book holding for reading, study, lecturing, teaching and other objectives;

Has an optional light with an optional on-board power source; and

Can be folded conveniently, quickly and compactly for carrying and storage.

This invention accomplishes the above and other objectives with a first-side book-support plate and a second-side book-support plate that are oppositely disposed at a desired angle on a plate-connecting member that is attachable to a connector bracket with which universality of positioning is provided by stand means that are designedly foldable. A first-side page holder that is adjustable separately to thickness of page bunches and a first-side book holder that is adjustable separately to book thicknesses are attachable to the first-side book-support plate. A second-side page holder that is adjustable separately to thickness of page bunches and a second-side book holder that is adjustable separately to book thicknesses are attachable to the second-side book-support plate. A first-side book-holder groove on a bottom side of the first-side book-support plate and a first-side adjustable clamp on a top side of the first-side book support plate provide linear book support on the first-side book-support plate. A second-side book-holder groove on a bottom side of the second-side book-support plate and a second-side adjustable clamp on a top side of the second-side book support plate provide linear book support on the second-side book-support plate.

The above and other objects, features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

This invention is described by appended claims in relation to description of a preferred embodiment with reference to the following drawings which are described briefly as follows:

FIG. 1 is a top view of a book-holder section;

FIG. 2 is a partial cutaway front view of a leaf-spring bracket having ways in sliding contact with a strap clamp;

FIG. 3 is a partial cutaway rear view of the FIG. 2 leaf-spring bracket;

FIG. 4 is a partial cutaway side view of the FIG. 2 leaf-spring bracket;

FIG. 6 is a partial cutaway side view of a book-holder plate attached pivotally to a support rod and having pages of a book positioned between the book-holder plate and a book holder;

FIG. 7 is a partial cutaway fragmentary view of opposed book-holder plates in relation to a connector bracket with pivotal attachment means;

FIG. 12 is a side elevation view of a book holder inverted for holding a book to be read from below a stand with optional casters;

FIG. 13 is a side elevation view of a book holder positioned horizontally for holding a book to be read from a reader's side beside a stand with optional casters; and FIG. 14 is a side elevation view of a book holder positioned vertically for holding a book to be read from a side of a stand that can be positioned as desired in relation to a chair or desk with optional casters.

DESCRIPTION OF PREFERRED EMBODIMENT

Figure 5:
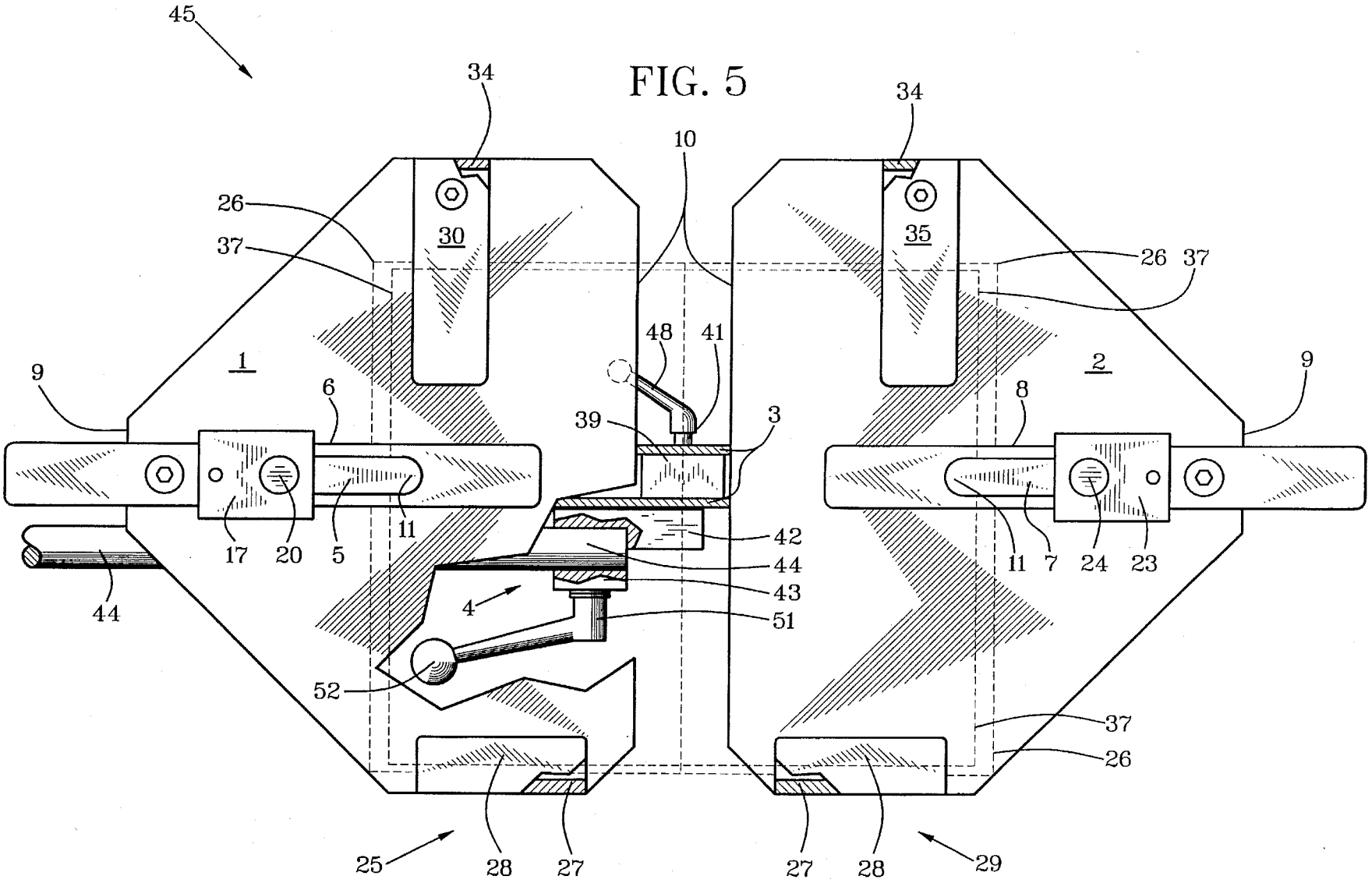
FIG. 5 is a front view of the FIG. 1 book-holder section.

Reference is made first to FIGS. 1–5. A first-side book-support plate 1 and a second-side book-support plate 2 are oppositely disposed at a desired angle on a plate-connecting member 3 to which a connector bracket 4 is attached. A first-side page holder 5 and a first-side book holder 6 are attached to the first-side book-support plate 1. A second-side page holder 7 and a second-side book holder 8 are attached to the second-side book-support plate 2.

The first-side book-support plate 1 and the second-side book-support plate 2 preferably, but not necessarily, have truncate triangular outside edges 9 and linear inside edges 10 that are oppositely disposed in parallel relationship as depicted in FIG. 5. The plate-connecting member 3 can be constructed variously but preferably is comprised of two parallel brackets extended from proximate the truncate triangular outside edges 9 to the connector bracket 4 that is positioned approximately midway between the linear inside edges 10 of book-support plates 1 and 2.

The first-side page holder 5 is preferably a designedly thin and, therefore, light-pressure leaf spring having a spring entryway 11 on an entry end of the leaf spring. The spring entryway 11 is preferably an arcuately upturned entry end of the leaf spring that allows pages being turned to be funnelled or finger-guided under it easily by a reader. The first-side book holder 6 is preferably a strip of plastic material that is a first strap clamp which functions as a side clamp with clamping pressure transmitted through a first side-clamp rod 12 that has a clamp end of the first side-clamp rod 12 attached to the first-side book holder 6.

The first side-clamp rod 12 is extended through a first side-rod orifice 13 to a spring keeper 14 on a spring end of the first side-clamp rod 12. The first side-clamp rod 12 is expansion-pressured with a side-clamp spring 15 between the spring keeper 14 and a back side of the first-side book-support plate 1. A spring guide 16 can be employed between the side-clamp spring 15 and the back side of the first-side book-support plate 1. The first side-clamp rod 12 and/or the first-side book holder 6 are freely pivotal in relation to the first-side book-support plate 1.

A first-side leaf-spring bracket 17 has side-clamp ways 18 in sliding contact with a first strap clamp of the first-side book holder 6. An attachment end of the leaf spring of the first-side page holder 5 is attached to the first-side leaf-spring bracket 17 at a spring-attachment wall 19 of the side-clamp ways 18. A first-side page-holder tension-adjustment bolt 20 is screwed through a machine-threaded tension-adjustment orifice in communication between the spring-attachment wall 19 of the side-clamp ways 18 and an outside periphery of the first-side leaf-spring bracket 17 at a page-holder-adjustment position in which an inside end of the first page-holder tension-adjustment bolt 20 is buttressed against a side of the first-side page-holder 5 leaf spring intermediate the attachment end of the first-side page-holder 5 leaf spring and an inside end of the first-side leaf-spring bracket 17.

The second-side page holder 7 and the second-side book holder 8 are constructed and attached similarly to the first-side page holder 5 and the first-side book holder 6. The second-side page holder 7 likewise is preferably a designedly thin and, therefore, light-pressure leaf spring having a spring entryway 11 on an entry end of the leaf spring. The spring entryway 11 is preferably an arcuately upturned entry end of the leaf spring that allows pages being turned to be funnelled or finger-guided under it easily by a reader.

The second-side book holder 8 is preferably a strip of plastic material that is a second strap clamp which functions as a side clamp with clamping pressure transmitted through a second side-clamp rod 21 that has a clamp end of the second side-clamp rod 21 attached to the second-side book holder 8. The second side-clamp rod 21 is extended through a second side-rod orifice 22 to a spring keeper 14 on a spring end of the second side-clamp rod 21. The second side-clamp rod 21 is expansion-pressured with a side-clamp spring 15 between the spring keeper 14 and a back side of the second-side book-support plate 2. A spring guide 16 can be employed between the side-clamp spring 15 and the back side of the second-side book-support plate 2. The second side-clamp rod 21 and/or the second-side book holder 8 are freely pivotal in relation to the second-side book-support plate 2.

A second-side leaf-spring bracket 23 has side-clamp ways 18 in sliding contact with a second strap clamp of the second-side book holder 8. An attachment end of the leaf spring of the second-side page holder 7 is attached to the second-side leaf-spring bracket 23 at a spring-attachment wall 19 of the side-clamp ways 18. A second-side page-holder tension-adjustment bolt 24 is screwed through a machine-threaded tension-adjustment orifice in communication between the spring-attachment wall 19 of the side-clamp ways 18 and an outside periphery of the second-side leaf-spring bracket 23 at a page-holder-adjustment position in which an inside end of the second page-holder tension-adjustment bolt 24 is buttressed against a side of the second-side page-holder 7 leaf spring intermediate the attachment end of the second-side page-holder 7 leaf spring and an inside end of the second-side leaf-spring bracket 23.

Reference is made now to FIG. 6 in addition to FIGS. 1–5. A first-side book-holder groove 25 is attached rigidly to a bottom side of the first-side book-support plate 1. The first-side book-holder groove 25 supports mass of a side of a book by support of a bottom edge of a book cover 26 on a bottom groove wall 27 of the first-side book-holder groove 25 when the book cover 26 is positioned between the first-side book-support plate 1 and a side wall plate 28 on the first-side book-holder groove 25. Similarly, a second-side book-holder groove 29 is attached rigidly to a bottom side of the second-side book-support plate 2. The second-side book-holder groove 29 supports mass of a side of a book by support of a bottom edge of a book cover 26 on a bottom groove wall 27 of the second-side book-holder groove 29 when the book cover 26 is positioned between the second-side book-support plate 2 and a side wall plate 28 on the second-side book-holder groove 29.

A first-side top-holder clamp 30 is attached pivotally to a top side of the first-side book-support plate 1 with a first top-clamp rod 31 that is extended through a top-rod orifice 32 in the first-side book-support plate 1. A clamp end of the first top-clamp rod 31 is attached to the first-side top-holder clamp 30. A spring end of the first top-clamp rod 31 is in expansion-spring tension with a top-clamp spring 33 expansion-biased between a back side of the first-side book-support plate 1 and the spring end ,If the first top-clamp rod 31. The first-side top-holder clamp 30 is preferably a strip of plastic having a top-clamp spacer wall 34 which positions the strip of plastic approximately as far from the first-side book-support plate 1 as the side wall plate 28. Similarly, a second-side top-holder clamp 35 is attached pivotally to a top side of the second-side book-support plate 2 with a second top-clamp rod 36 that is extended through a top-rod orifice 32 in the second-side book-support plate 2. A clamp end of the second top-clamp rod 36 is attached to the second-side top-holder clamp 35. A spring end of the second top-clamp rod 36 is in expansion-spring tension with a top-clamp spring 33 expansion-biased between a back side of the second-side book-support plate 2 and the spring end of the second top-clamp rod 36. The second-side top-holder clamp 35 is preferably a strip of plastic having a top-clamp spacer wall 34 which positions the strip of plastic approximately as far from the second-side book-support plate 2 as the side wall plate 28.

Figure 8:
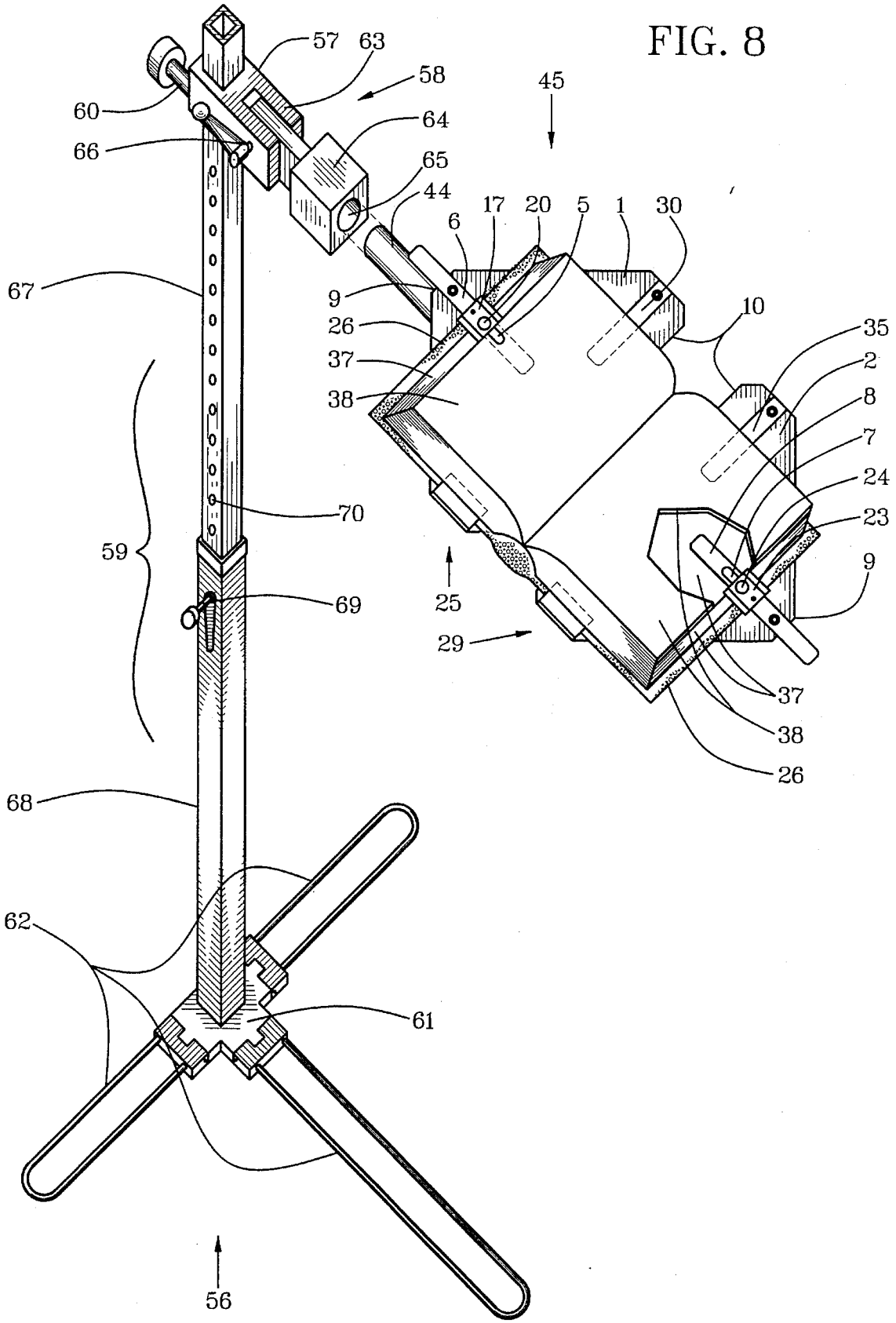
FIG. 8 is a perspective view of book holder on a stand with foldable platform appendages.
Figure 9:
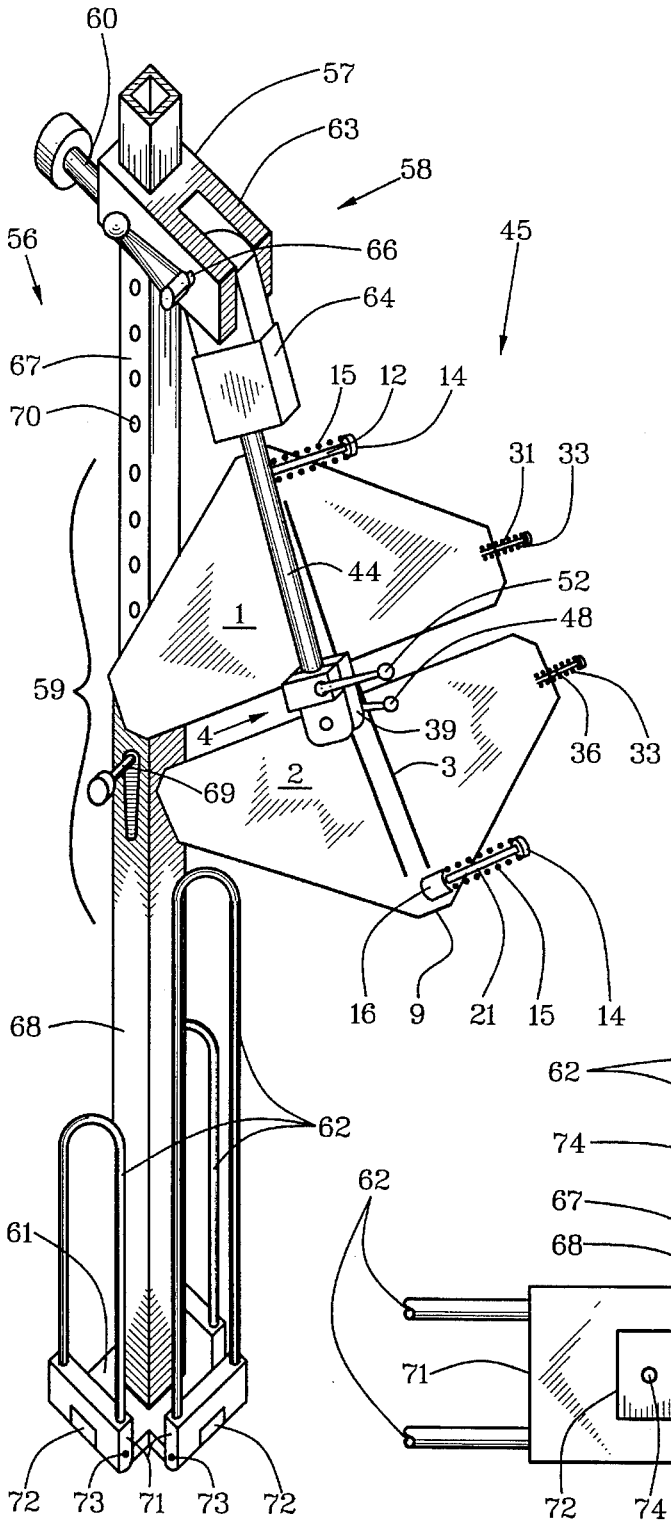
FIG. 9 is a perspective view of book holder in pivotally folded relationship to a stand with folded platform appendages.
Figure 10:
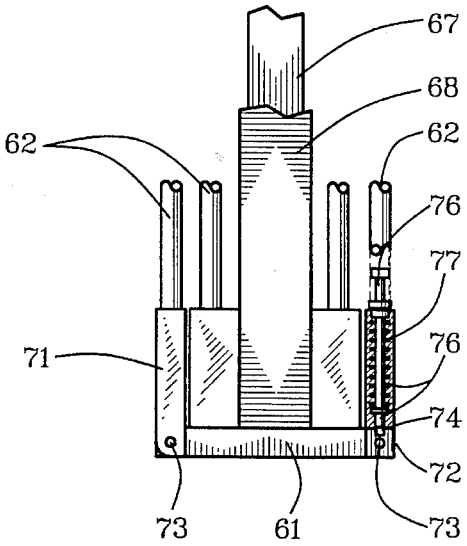
FIG. 10 is a partially cutaway fragmentary view of the FIG. 9 stand with the platform appendages in ratchet-locked folded condition for portability and storage.
Figure 11:
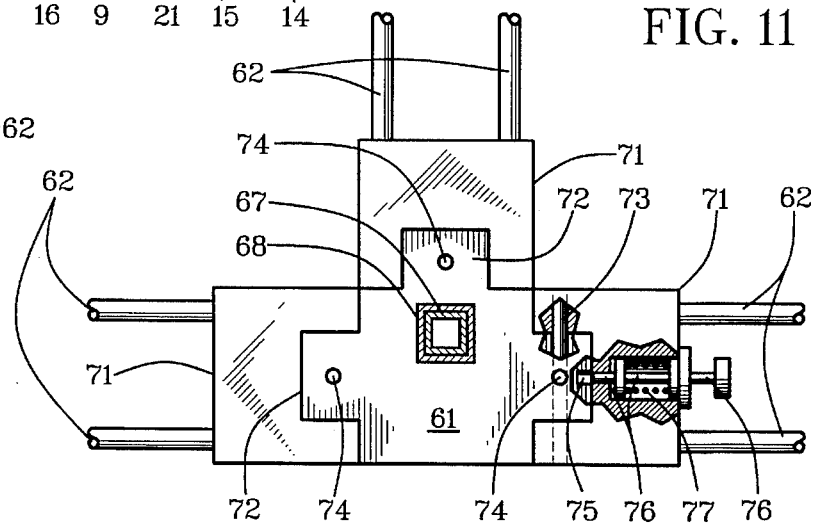
FIG. 11 is a partially cutaway fragmentary top view of the FIG. 8 stand in ratchet-locked unfolded condition for use.

Referring to FIG. 8 in addition to FIGS. 1–7, a method for using this book holder includes first positioning a bottom edge of the book cover 26 in the book-holder grooves 25 and 29. Then the top-holder clamps 30 and 35 are pivoted to appropriate angularity for clamping into a top of whatever size of book cover 26 is positioned in the book-holder grooves 25 and 29. The top-holder clamps 30 and 35 are pivotal and spring tensioned to facilitate their positioning on a top portion of the book cover 26 after a bottom portion of the book cover 26 has been positioned in the book-holder grooves 25 and 29. Next, book sides 37 comprising most pages not anticipated to be read and/or turned soon during a reading session are positioned proportionately as desired under the first-side book holder 6 and under the second-side book holder 8. Then the first-side page-holder tension-adjustment bolt 20 is finger-turned to adjust tension of the first-side page holder 5 to hold a desired number of pages with a desired tightness for ease of inserting the desired number of pages one-by-one under the first-side page holder 5 by merely pushing the pages against the spring entryway 11 as the pages are turned. Then the second-side page-holder tension-adjustment bolt 24 is finger-turned to adjust tension of the second-side page holder 7 to hold a desired number of pages with a desired tightness for ease of removing the desired number of pages one-by-one from under the second-side page holder 7 by lightly pushing the pages out from under the spring entryway 11 in a direction towards a center of a book as the pages are turned. Pages turned during a reading session are stored between the page holder 5 and the book holder 6 on one side and between the page holder 7 and the book holder 8 on the opposite side of a book.

Adjustments of amounts of pages comprising book sides 37 positioned under the book holders 6 and 8 and the amounts of pages comprising reading-session pages 38 positioned under the page holders 5 and 7 are made as desired in relation to reading times or anticipated reading periods. In FIG. 5, dashed lines are used to indicate a book cover 26 and book sides 37. In FIG. 1, pages comprising book sides 37 are illustrated separately from reading-session pages 38.

Referring to FIGS. 1 and 5–7, the plate-connecting member 3 can have an attachment appendage 39 with a bearing orifice 40 into which an adjustment axle 41 is inserted for attachment with adjustable tightness onto a split-sleeve base member 42 and a sleeve-clamp member 43 on the connector bracket 4. The plate-connecting member 3 can be adjusted 360 degrees rotationally at perpendicularity to an axis of a support rod 44 on which the plate-connecting member 3 is adjustable 360 degrees rotationally. This perpendicularity of 360-degree rotations provides a form of universal adjustment of a book-holder assembly 45.

The adjustment axle 41 can have axle threading 46 with which the adjustment axle 41 is screwed into the sleeve base member 42 to provide selective tightening tension between the axle threading 46 and an axle base 47, with or without washers as shown, between the attachment appendage 39 and the axle base 47. An axle handle 48 of a variety of forms can be provided for hand-tightening the attachment appendage 39 onto the sleeve base member 42 with the adjustment axle 41.

The sleeve clamp member 43 can be tightened selectively onto the sleeve base member 42 with a clamp axle 49 having clamp-axle threading 50, a clamp-axle base 51 and a clamp handle 52. With a support rod 44 inserted into a base half-shell 53 and a clamp half-shell 54, the clamp handle 52 can be rotated selectively to provide desired thread-tightening tension or release of thread-tightening tension of the clamp-axle base 51, together with optional washers as shown, to articulate the sleeve-clamp member 43 in relation to the support rod 44 and the sleeve base member 42. The sleeve clamp member 43 can be maintained in workable relationship to the sleeve base member 42 and the support rod 44 by a fastener bolt 55.

Reference is made now to FIGS. 8–11. The book-holder assembly 45 can be attached with or without the support rod 44 to a wide variety of bases. A preferred adjustable base 56 is foldable for use with the support rod 44. A stand end of the support rod 44 is pivotally attached to a stand clamp 57 with a controlled-pivot fastener means 58. An inside periphery of the stand clamp 57 is in sliding contact with an outside periphery of a telescopic pillar 59 onto which the stand clamp 57 is positioned selectively at desired heights and fastened with a clamp-tightening bolt 60 that can be forced against and/or screwed into a side of the telescopic pillar 59 from an adjacent wall of the stand clamp 57. A bottom end of the telescopic pillar 59 can be attached to a stand base 61. The stand base 61 can have at least three platform appendages 62 that can be foldable from a ratchet-lockable horizontal attitude to a ratchet-lockable vertical attitude in design proximity to the telescopic pillar 59.

The support rod 44 can be attached pivotally to the stand clamp 57 with a pivot yoke 63 having a yoke-attachment base 64 with a rod receptacle 65 into which the support rod 44 is inserted and tightened with appropriate fastener means. The pivot yoke 63 can be pivotal on a yoke axle 66 that can be thread-tightened between opposite sides of the pivot yoke 63 to permit adjustable attitude of the support rod 44 in relationship to the telescopic pillar 59. Attitudinal adjustment of the support rod 44 on the yoke axle 66 can provide additional use-attitude adjustment in addition to folding of the book-holder assembly 45.

The telescopic pillar 59 can have an inside pillar section 67 that is positioned vertically in an outside pillar section 68 with a spring-loaded bolt 69 that communicates between the outside pillar section 68 and adjustment orifices 70 in the inside pillar section 67.

Ratchet-lockable folding of the platform appendages 62 in horizontal and vertical attitudes can be provided with platform bases 71 to which the platform appendages 62 are attachable. The platform bases 71 can be hinged to hinge bases 72 on the stand base 61 with hinge rods 73. A vertical ratchet bay 74 and a horizontal ratchet bay 75 in the hinge bases 72 can receive a ratchet rod 76 that is spring-tensioned towards the hinge bases 72 with a ratchet spring 77 in each of the platform bases 71. In a cutaway portion of FIG. 10, the ratchet rod 76 is poised to enter the vertical ratchet bay 74 in a top of a hinge base 72. In a cutaway portion of FIG. 11, the ratchet rod 76 is poised to enter the horizontal ratchet bay 75 in a side of a hinge base 72.

Reference is made now to FIGS. 12–14. The book-holder assembly 45 described in relation to FIGS. 1 and 5–8 can be supported by a mobile stand base 78 having casters 79. The support rod 44 can be inserted in a height-adjustable clamp 80 that can be positioned on a stand pillar 81 selectively with a clamp fastener 82. The stand pillar 81 is attached to the stand base 78.

Owing to universality of attitude adjustment of the book-holder assembly 45 as described in relation to FIGS. 1 and 5–8, inverted positioning illustrated in FIG. 12, side positioning illustrated in FIG. 13 and front positioning illustrated in FIG. 14 are made possible. Unlimited analog variations of these positioning attitudes also are possible. Inverted positioning is primarily for reading on a reader's back in a variously prone position. Side positioning is primarily for reading on a reader's side. Front positioning is for reading while sitting at a desk or in a chair independently of other furnishings. Front positioning is also for reading while standing or lecturing.

In all types of stand bases 61 and 78, supportive compensation for the support rod 44 and the book-holder assembly 45 can be provided by extension of portions of the bases 61 and 78 vertically under the support rod 44 and the book-holder assembly 45.

Referring to FIGS. 1 and 12–13, a reading lamp 83 with an on-board power source 84 or with an outside power source can be positioned where and as desired in relation to the book-holder assembly 45.

A new and useful book holder and method having been described, all such modifications, adaptations, substitutions of equivalents, combinations of parts, applications and forms thereof as described by the following claims are included in this invention.

I claim:

1. A book holder comprising:

a first-side book-support plate and a second-side book-support plate that are oppositely disposed at a desired angle on a plate-connecting member;

a connector bracket attached to the plate-connecting member;

a first-side page holder and a first-side book holder attached to the first-side book-support plate;

a second-side page holder and a second-side book holder attached to the second-side book-support plate;

a first-side book-holder groove on a bottom side of the first-side book-support plate;

a first-side top-holder clamp on a top side of the first-side book-support plate;

a second-side book-holder groove on a bottom side of the second-side book-support plate; and a second-side top-holder clamp on a top side of the second-side book-support plate.

2. A book holder as described in claim 1 wherein:

the first-side book-support plate and the second-side book-support plate have truncate triangular outside edges and linear inside edges that are oppositely disposed in parallel relationship;

the plate-connecting member is attached centrally to a back side of the first-side book-support plate and to a back side of the second-side book-support member; and the plate-connecting member is perpendicular to the linear inside edges of the first-side book-support plate and the second-side book-support plate.

3. A book holder as described in claim 1 wherein:

the desired angle on the plate-connecting member at which the first-side book-support member and the second-side book-support member are oppositely disposed is a design obtuse angle designedly near to 180 degrees.

4. A book holder as described in claim 1, wherein:

the first-side book-support plate and the second-side book-support plate are constructed of designedly transparent plastic material.

5. A book holder as described in claim 2 wherein:

the desired angle on the plate-connecting member at which the first-side book-support member and the second-side book-support member are oppositely disposed is a design obtuse angle designedly near to 180 degrees; and the first-side book-support plate and the second-side book-support plate are constructed of designedly transparent plastic material.

6. A book holder as described in claim 1 wherein:

the connector bracket is a split-sleeve attachment having a sleeve-tightening means on an adjustment side of the split-sleeve attachment;

the split-sleeve attachment being sized and shaped to receive a support rod; and a swivel attachment on the plate-connecting member has a swivel axis perpendicular to the split-sleeve attachment.

7. A book holder as described in claim 6 and further comprising:

fastener means on the connector bracket.

8. A book holder as described in claim 1 wherein:

the first-side page holder and the second-side page holder are page-holder leaf springs having design lightness of leaf-spring pressure; and spring entryways are positioned on entry ends of the page-holder leaf springs.

9. A book holder as described in claim 8 wherein:

the first-side book holder and the second-side book holder are adjustable side clamps attached to the first-side book-support plate and to the second-side book-support plate with a first side-clamp rod and a second side-clamp rod, respectively, wherein the first side-clamp rod is extended through a first side-rod orifice in the first-side book-support plate and the second side-clamp rod is extended through a second side-rod orifice in the second-side book-support plate;

a clamp end of the first side-clamp rod is attached to the first-side book holder;

a spring end of the first side-clamp rod is in spring tension with a side-clamp spring expansion-biased between a back side of the first-side book-support plate and the spring end of the first side-clamp rod;

a clamp end of the second side-clamp rod is attached to the second-side book holder; and a spring end of the second side-clamp rod is in spring tension with a side-clamp spring expansion-biased between a back side of the second-side book-support plate and the spring end of the second side-clamp rod.

10. A book holder as described in claim 9 wherein:

the adjustable side clamps comprising the first-side book holder and the second-side book holder are a first strap clamp and a second strap clamp, respectively.

11. A book holder as described in claim 10 and further comprising:

a first-side leaf-spring bracket having side-clamp ways in sliding contact with the first strap clamp;

an attachment end of the first-side page-holder leaf spring attached to the first-side leaf-spring bracket at an attachment wall of the side-clamp ways;

a first page-holder tension-adjustment bolt that is screwed through a machine-threaded tension-adjustment orifice in communication between the attachment wall of the side-clamp ways and an outside periphery of the first-side leaf-spring bracket at a page-holder-adjustment position in which an inside end of the first page-holder tension-adjustment bolt is buttressed against a side of the first-side page-holder leaf spring intermediate the attachment end of the first-side page-holder leaf spring and an inside end of the first-side leaf-spring bracket;

a second-side leaf-spring bracket having side-clamp ways in sliding contact with the second strap clamp;

an attachment end of the second-side page-holder leaf spring attached to the second-side leaf-spring bracket at an attachment wall of the side-clamp ways; and a second page-holder tension-adjustment bolt that is screwed through a machine-threaded tension-adjustment orifice in communication between the attachment wall of the side-clamp ways and an outside periphery of the second-side leaf-spring bracket at a page-holder-adjustment position in which an inside end of the second page-holder tension-adjustment bolt is buttressed against a side of the second-side page-holder leaf spring intermediate the attachment end of the second-side page-holder leaf spring and an inside end of the second-side leaf-spring bracket.

12. A book holder as described in claim 1 wherein:

the first-side book-holder groove and the second-side book-holder groove have side-wall plates positioned a design distance from the bottoms of the first-side book-support plate and the second-side book-support plate for receiving a design range of thicknesses of book covers.

13. A book holder as described in claim 1 wherein:

the first-side top-holder clamp and the second-side top-holder clamp are adjustable top clamps attached to the top of the first-side book-support plate and to the top of the second-side book-support plate with a first top-clamp rod and a second top-clamp rod respectively;

the first top-clamp rod is extended through a first top-rod orifice in the first-side book-support plate;

the second top-clamp rod is extended through a second top-rod orifice in the second-side book-support plate;

a clamp end of the first top-clamp rod is attached to the first-side top-holder clamp;

a spring end of the first top-clamp rod is in spring tension with a top-clamp spring expansion-biased between a back side of the first-side book-support plate and the spring end of the first top-clamp rod;

a clamp end of the second top-clamp rod is attached to the second-side top-holder clamp; and a spring end of the second top-clamp rod is in spring tension with a top-clamp spring expansion-biased between a back side of the second-side book-support plate and the spring end of the second top-clamp rod.

14. A book holder as described in claim 1 and further comprising:

a stand attached to the connector bracket.

15. A book holder as described in claim 14 wherein the stand is a designedly adjustable stand having:

a support rod having a support section in sliding contact with an inside periphery of a split-sleeve attachment with a sleeve-tightening means on the connector bracket;

the inside periphery of the split-sleeve attachment is sized and shaped to receive the support section of the support rod in sliding contact;

a swivel attachment on the plate-connecting member that has a swivel axis perpendicular to a sleeve axis of the split-sleeve attachment;

a stand end of the support rod that is pivotally attached to a stand clamp with a controlled-pivot fastener means;

the stand clamp having an inside periphery in vertically sliding contact with an outside periphery of a telescopic pillar onto which the stand clamp is positioned selectively at desired heights and fastened with a clamp-tightening means; and a bottom end of the telescopic pillar is attached to a stand base.

16. A book holder as described in claim 15 wherein:

the stand base has at least three platform appendages.

17. A book holder as described in claim 16 wherein:

the at-least-three platform appendages are foldable on axes from ratchet-lockable horizontal attitudes to ratchet-lockable vertical attitudes parallel and in design proximity to the telescopic pillar.

18. A book holder as described in claim 15 and further comprising:

casters on the stand base.

19. A book holder as described in claim 16 and further comprising:

casters on the stand base.

20. A book holder comprising:

a first-side book-support plate and a second-side book-support plate that are oppositely disposed at a desired angle on a plate-connecting member;

a connector bracket attached to the plate-connecting member;

a first-side page holder and a first-side book holder attached to the first-side book-support plate;

a second-side page holder and a second-side book holder attached to the second-side book-support plate;

a first-side book-holder groove on a bottom side of the first-side book-support plate;

a first-side top-holder clamp on a top side of the first-side book-support plate;

a second-side book-holder groove on a bottom side of the second-side book-support plate;

a second-side top-holder clamp on a top side of the second-side book-support plate;

the first-side book-support plate and the second-side book-support plate have truncate triangular outside edges and linear inside edges that are oppositely disposed in parallel relationship;

the plate-connecting member is attached centrally to a back side of the first-side book-support plate and to a back side of the second-side book-support member;

the plate-connecting plate being perpendicular to the linear inside edges of the first-side book-support plate and the second-side book-support plate;

the desired angle on the plate-connecting member at which the first-side book-support plate and the second-side book-support plate are oppositely disposed is a design obtuse angle designedly near to 180 degrees;

the first-side book-support plate and the second-side book-support plate are constructed of designedly transparent plastic material;

the connector bracket is a split-sleeve attachment having a sleeve-tightening means on an adjustment side of the split-sleeve attachment;

the split-sleeve attachment being sized and shaped to receive a support rod;

a swivel attachment on the plate-connecting member having a swivel axis perpendicular to the split-sleeve attachment;

the first-side page holder and the second-side page holder are page-holder leaf springs having design lightness of leaf-spring pressure;

spring entryways are positioned on entry ends of the page-holder leaf springs;

the first-side book holder and the second-side book holder are adjustable side clamps attached to the first-side book-support plate and to the second-side book-support plate with a first side-clamp rod and a second side-clamp rod, respectively, wherein the first side-clamp rod is extended through a first side-rod orifice in the first-side book-support plate and the second side-clamp rod is extended through a second side-rod orifice in the second-side book-support plate;

a clamp end of the first side-clamp rod attached to the first-side book holder;

a spring end of the first side-clamp rod is in spring tension with a side-clamp spring expansion-biased between a back side of the first-side book-support plate and the spring end of the first side-clamp rod;

a clamp end of the second side-clamp rod is attached to the second-side book holder;

a spring end of the second side-clamp rod is in spring tension with a side-clamp spring expansion-biased between a back side of the second-side book-support plate and the spring end of the second side-clamp rod;

the first-side adjustable side clamps and the second-side-adjustable side clamps are a first strap clamp and a second strap clamp respectively;

a first-side leaf-spring bracket having side-clamp ways in sliding contact with the first strap clamp;

an attachment end of the first-side page-holder leaf spring attached to the first-side leaf-spring bracket at an attachment wall of the side-clamp ways;

a first page-holder tension-adjustment bolt that is screwed through a machine-threaded tension-adjustment orifice in communication between the attachment wall of the side-clamp ways and an outside periphery of the first-side leaf-spring bracket at a page-holder-adjustment position in which an inside end of the first page-holder tension-adjustment bolt is buttressed against a side of the first-side page-holder leaf spring intermediate the attachment end of the first-side page-holder leaf spring and an inside end of the first-side leaf-spring bracket;

a second-side leaf-spring bracket having side-clamp ways in sliding contact with the second strap clamp;

an attachment end of the second-side page-holder leaf spring attached to the second-side leaf-spring bracket at an attachment wall of the side-clamp ways;

a second page-holder tension-adjustment bolt that is screwed through a machine-threaded tension-adjustment orifice in communication between the attachment wall of the side-clamp ways and an outside periphery of the second-side leaf-spring bracket at a page-holder-adjustment position in which an inside end of the second page-holder tension-adjustment bolt is buttressed against a side of the second-side page-holder leaf spring intermediate the attachment end of the second-side page-holder leaf spring and an inside end of the second-side leaf-spring bracket;

the first-side book-holder groove and the second-side book-holder groove have side-wall plates positioned a design distance from the bottoms of the first-side book-support plate and the second-side book-support plate for receiving a design range of thicknesses of book covers;

the first-side top-holder clamp and the second-side top-holder clamp are adjustable top clamps attached to the top of the first-side book-support plate and to the top of the second-side book-support plate with a first top-clamp rod and a second top-clamp rod respectively;

the first top-clamp rod is extended through a first top-rod orifice in the first-side book-support plate;

the second top-clamp rod is extended through a second top-rod orifice in the second-side book-support plate;

a clamp end of the first top-clamp rod is attached to the first-side top-holder clamp;

a spring end of the first top-clamp rod is in spring tension with a top-clamp spring expansion-biased between a back side of the first-side book-support plate and the spring end of the first top-clamp rod;

a clamp end of the second top-clamp rod is attached to the second-side top-holder clamp; and a spring end of the second top-clamp rod is in spring tension with a top-clamp spring expansion-biased between a back side of the second-side book-support plate and the spring end of the second top-clamp rod.

21. A book holder as described in claim 20 and further comprising a universally adjustable stand attached to the connector bracket and having:

a support rod having a support section in sliding contact with an inside periphery of a split-sleeve attachment having a sleeve-tightening means on the connector bracket;

the inside periphery of the split-sleeve attachment is sized and shaped to receive the support section of the support rod in sliding contact;

a swivel attachment on the plate-connecting member has a swivel axis perpendicular to a sleeve axis of the split-sleeve attachment;

a stand end of the support rod is pivotally attached to a stand clamp with a controlled-pivot fastener means;

the stand clamp has an inside periphery in vertically sliding contact with an outside periphery of a telescopic pillar onto which the stand clamp is positioned selectively at desired heights and fastened with a clamp-tightening means;

a bottom end of the telescopic pillar is attached to a stand base; and the stand base has at least three platform appendages.

22. A book holder as described in claim 21 and further comprising:

folding and locking means with which the at-least-three platform appendages are foldable on axes from ratchet-lockable horizontal attitudes to ratchet-lockable vertical attitudes parallel to and in designedly close proximity to the telescopic pillar.

23. A book holder as described in claim 21 and further comprising:

casters on the stand base.

24. A method for using a book holder having:

a first-side book-support plate and a second-side book-support plate that are oppositely disposed at a desired angle on a plate-connecting member;

a connector bracket attached to the plate-connecting member;

a first-side page holder and a first-side book holder attached to the first-side book-support plate;

a second-side page holder and a second-side book holder attached to the second-side book-support plate;

a first-side book-holder groove on a bottom side of the first-side book-support plate;

a first-side top-holder clamp on a top side of the first-side book-support plate;

a second-side book-holder groove on a bottom side of the second-side book-support plate; and a second-side top-holder clamp on a top side of the second-side book-support plate;

the method having the following steps:

positioning a bottom edge of a book cover in the book-holder grooves;

pivoting the top-holder clamps to appropriate angularity for positioning on a book of a desired size;

positioning the top-holder clamps onto top portions of a book cover of the book;

positioning book sides which include a bulk of pages not anticipated to be read and turned during a reading session proportionately as desired under the first-side book holder and under the second-side book holder respectively on the first-side book-support plate and on the second-side book-support plate;

adjusting spring tension of the second-side page holder to hold with desired tension a desired amount of anticipated-reading pages between the second-side page holder and the second-side book holder;

adjusting spring tension of the first-side page holder to hold with desired tension a desired amount of anticipated-turned pages between the first-side page holder and the first-side book holder;

positioning the desired amount of anticipated-reading pages between the second-side page holder and the second-side book holder;

removing the anticipated-reading pages from between the second-side page holder and the second-side book holder as desired;

turning pages from a proximity of the second-side page holder to a proximity of the first-side page holder as desired; and positioning turned pages between the first-side page holder and the first-side book holder as desired.

25. A method as described in claim 24 and further comprising:

adjusting amounts of pages which are book sides under the first-side book holder and under the second-side book holder in proportion to amounts of anticipated-reading pages and anticipated-turned pages as appropriate for desired reading sessions.

* * * * *